US006612128B2

(12) United States Patent
Dickson et al.

(10) Patent No.: US 6,612,128 B2
(45) Date of Patent: Sep. 2, 2003

(54) ACCUMULATOR FOR AN AIR-CONDITIONING SYSTEM

(75) Inventors: Timothy Russell Dickson, Kingston (CA); Kenneth Peter Luke Cram, Belleville (CA); Matthew Bryan Nuss, Belleville (CA); Steven Murray Rhodes, Kingston (CA); Ki-Sun Jason Ryu, Belleville (CA); Michelle Marie Stobbart, Belleville (CA)

(73) Assignee: Halla Climate Control Canada Inc., Belleville (CA)

( * ) Notice: Subject to any disclaimer, the term of this patent is extended or adjusted under 35 U.S.C. 154(b) by 0 days.

(21) Appl. No.: 10/182,338

(22) PCT Filed: Jan. 26, 2001

(86) PCT No.: PCT/CA01/00083

§ 371 (c)(1),
(2), (4) Date: Oct. 16, 2002

(87) PCT Pub. No.: WO01/55652

PCT Pub. Date: Aug. 2, 2001

(65) Prior Publication Data

US 2003/0056532 A1 Mar. 27, 2003

(30) Foreign Application Priority Data

Jan. 28, 2000 (CA) ..... 2297598

(51) Int. Cl.[7] ..... F25D 43/02

(52) U.S. Cl. ..... 62/471; 62/503; 62/513; 62/509

(58) Field of Search ..... 62/471, 503, 513, 62/509

(56) References Cited

U.S. PATENT DOCUMENTS

| | | | | |
|---|---|---|---|---|
| 4,331,001 A | | 5/1982 | Jones | |
| 4,354,362 A | | 10/1982 | Schumacher et al. | |
| 4,509,340 A | | 4/1985 | Mullally et al. | |
| 4,537,045 A | * | 8/1985 | Mayer | 62/503 |
| 4,627,247 A | | 12/1986 | Morse | |
| 4,768,335 A | | 9/1988 | McLean et al. | |
| 4,994,185 A | | 2/1991 | Cullen et al. | |
| 5,075,967 A | | 12/1991 | Bottum | |
| 5,471,854 A | | 12/1995 | DeNolf | |
| 5,479,790 A | * | 1/1996 | Bottum, Jr. et al. | 62/503 |
| 5,778,697 A | | 7/1998 | Wantuck | |
| 5,787,729 A | | 8/1998 | Wijaya | |
| 6,148,632 A | | 11/2000 | Kishita et al. | |
| 6,253,573 B1 | * | 7/2001 | Schwitters et al. | 62/513 |
| 6,298,687 B1 | | 10/2001 | Dienhart et al. | |
| 6,467,300 B1 | * | 10/2002 | Noble, III | 62/472 |

FOREIGN PATENT DOCUMENTS

| | | |
|---|---|---|
| CA | 2141153 | 1/1999 |
| DE | 2658086 A1 | 9/1977 |
| DE | 19903833 A1 | 8/2000 |
| DE | 19944950 A1 | 3/2001 |
| EP | 0 894 651 A2 | 2/1999 |

* cited by examiner

*Primary Examiner*—William Doerrler
*Assistant Examiner*—Mark S. Shulman
(74) *Attorney, Agent, or Firm*—Baker & Daniels

(57) ABSTRACT

Accumulator (10, 100) for an air-conditioning system. The inlet (58) fluid separation can be controlled, and there is control of the amount of compressor oil in circulation through an adjustable coupling between the interior and the outlet passage (56). Desiccating material (48) can be accommodated in many orientations, and can be made of various materials. The accumulator (10, 100) embodies an outer housing (12, 14) of two or more pieces and an inner liner (16) that is of one or more pieces. The inlet (58) directs the refrigerant into the inner volume formed by the liner (16), wherein the liquid refrigerant and compressor oil are contained and insulated from the wall (12, 14) of the outer housing.

18 Claims, 6 Drawing Sheets

ACCUMULATOR FOR AN AIR-CONDITIONING SYSTEM

The present invention relates to an accumulator for use in an air-conditioning system, and more particularly to a suction accumulator for use in an air-conditioning system of a motor vehicle.

Closed-loop refrigeration systems conventionally employ a compressor that is meant to draw in gaseous refrigerant at relatively low pressure and discharge hot refrigerant at relatively high pressure. The hot refrigerant condenses into liquid as it is cooled in a condenser. A small orifice or valve divides the system into high and low-pressure sides. The liquid on the high-pressure side passes through the orifice or valve and turns into a gas in the evaporator as it picks up heat. At low heat loads it is not desirable or possible to evaporate all the liquid. However, liquid refrigerant entering the compressor (known as "flooding") causes system efficiency loss and can cause damage to the compressor. Hence it is standard practice to include an accumulator between the evaporator and the compressor to separate and store the excess liquid.

An accumulator is typically a metal can, welded together, and often has fittings attached for a switch and/or charge port. One or more inlet tubes and an outlet tube pierce the top, sides, or occasionally the bottom, or attach to fittings provided for that purpose. The refrigerant flowing into a typical accumulator will impinge upon a deflector or baffle intended to reduce the likelihood of liquid flowing out the exit.

There are many inventions of baffles and deflectors in the prior art, all designed to reduce liquid carryover (see for instance U.S. Pat. Nos. 5,787,729, 5,201,792, 5,184,479, 5,021,792, 4,768,355, 4,270,934, and 4,229,949), and the prior art includes designs that claim not to need deflectors (U.S. Pat. Nos. 5,179,844, 5,471,854). However in current standard use most accumulators use a variation of the dome (U.S. Pat. No. 4,474,035) or "dixie cup" (U.S. Pat. No. 411,005) deflector—usually because these are the simplest and most cost-effective.

All deflector designs sacrifice some effective internal volume, as the beginning of the outlet tube must be underneath the deflector. Size is critical in accumulator application, hence there is a need for a more cost-effective design that does not need a deflector.

Some prior art is concerned with reducing the turbulence of the inlet flow (U.S. Pat. No. 5,184,480) as a way to reduce liquid carryover. Other designs are more concerned with the coupling between the inner reservoir and the outlet passage (U.S. Pat. Nos. 5,660,058, 5,179,844, 4,627,247), mainly to reduce the pressure drop across the accumulator (a critical system performance parameter).

The outlet tube is a main feature of accumulators in the prior art. Compressor oil is circulated with the refrigerant in all but very special systems. In systems where compressor oil circulates with the refrigerant the oil will settle out of the stream into the bottom of the liquid reservoir area of the accumulator. Some means must be provided to return this oil to circulation. Much of the prior art is concerned with various tubes, shapes and configurations to accomplish this with the minimum amount of oil inventory left in the accumulator (U.S. Pat. Nos. 5,660,058, 5,778,697, 5,052,193, 4,354,362, 4,199,960). The typical current practice uses a J-shaped outlet tube to carry the exiting gaseous refrigerant from the top of the accumulator down to the bottom and then back up to the outlet from the accumulator. A carefully sized orifice at the bottom of the J-tube entrains the oil from the bottom of the liquid area into the stream of exiting gas. Generally the orifice has a filter around it, and the filter and oil pickup may extend into a sump formed in the bottom of the can to collect the oil.

Another key feature of the prior art is the inclusion of a desiccant in the accumulator. Some refrigerant systems are more susceptible to moisture ingression and damage than others, especially less modern systems. For many systems it is necessary to remove any moisture, and the accumulator is a convenient spot to house the desiccant. Many early designs featured desiccant cartridges and the like (U.S. Pat. Nos. 4,509,340, 4,633,679, 4,768,355, 4,331,001), but the typical modern usage is a fabric bag of some suitable shape, full of desiccant beads and secured to some inner feature of the accumulator (like the J-tube) where the beads will contact the liquid refrigerant.

Another feature typical of the prior art is an anti-siphon measure, which prevents the liquid from siphoning or flowing out of the accumulator reservoir when the system is switched off. Complicated systems have been proposed (U.S. Pat. No. 5,347,829), but the standard technique is a hole near the top of the outlet J-tube to break any siphon effect. The size of the hole is a balance between breaking any siphon and reducing the effectiveness of oil pickup.

A further feature typical of the prior art is the use of insulation placed around the outside of accumulators to modify the thermal characteristics (U.S. Pat. No. 5,701,759). This is an added expense and is only used when required to reduce flooding.

Many examples of prior art (for example U.S. Pat. No. 5,365,751) are proposed as simple, flexible designs that can be easily manufactured for many installations. Since in practice several designs are in use, it is evident that such a multi-purpose design has not been realized in the prior art. An accumulator with reduced number of parts and improved performance is required.

SUMMARY OF THE INVENTION

The invention provides an accumulator for use in air-conditioning system comprising: a hermetically sealed outer housing comprising a top, an inlet opening, a peripheral side wall, and a base; an inner liner positioned within said outer housing, said inner liner having a peripheral wall and a base which form a container to receive refrigerant delivered through said inlet opening, said inner liner being spaced from the peripheral wall and the base of said outer housing to define therewith an annular passage, said inner liner having an upper edge that is spaced from said outer housing; passage means extending around the upper edge of said inner liner and communicating the interior of said inner liner with a first upper end of said annular passage; an outlet passage opening from a second lower end of said annular passage at a location between the base of the inner liner and the base of the outer housing, said outlet passage leading to the exterior of said outer housing; the arrangement being such that vaporized refrigerant can pass through said passage means from said inner liner to the upper end of said annular passage, descend downwards through said annular passage to the opening of said outlet passage, and exit said accumulator via said outlet passage.

In one embodiment the outer housing comprises an open topped deep-drawn metal can sealed by a cap through which the inlet opening and an outlet port for the outlet passage extend. In this arrangement the upper edge of the inner liner engages the underside of the cap. The cap preferably is hermetically sealed to the top of the peripheral side wall of the outer housing and may include the inlet opening and also an outlet port for said outlet passage.

Preferably the passage means is formed by a substantially continuous gap between the upper end of the inner liner and the cap, and through this gap refrigerant in gaseous state can pass from the inner container to the annular passage where it can descend between the inner and outer walls to reach the outlet passage at the base. The annular gap is preferably baffled so that it is shielded from passage of liquid refrigerant added to the inner container through the inlet. The passage defined by the annular gap can be configured to create turbulence in the flow of refrigerant gas passing therethrough. The interior of the inner container preferably includes baffles to prevent excessive movement of the refrigerant liquid contained therein. Such a baffle may be provided in the form of a desiccant body positioned in the inner container to take up any water that may be present, the desiccant body preventing liquid refrigerant reaching to the top of the inner container as a result of erratic motion of the accumulator, as can typically occur in automotive installations.

The inner liner preferably includes integral projections on the exterior thereof positioned to engage the outer container and provide a desired spacing therewith.

The inner container is preferably of low thermal conductivity thus to prevent excessive heating of liquid refrigerant therein as a result of heat radiated from the outer container.

There is preferably a bleed hole in the base of the inner container through which accumulated oil can bleed to become entrained in the flow of refrigerant gas moving towards the outlet passage. Preferably rib means between the bases of the inner and outer containers directs such flow in refrigerant gas to pass over the oil bleed passage.

The preferred embodiment of the accumulator for an air-conditioning system as hereinafter disclosed has fewer parts as compared to the prior art, is more effective, and is easier and cheaper to manufacture. It reduces flooding due to greater effective internal volume, better evaporation, an integral baffle, and controlled thermal properties. The inlet fluid separation can be controlled. Further, it has greater control of the amount of compressor oil in circulation, and adjustable coupling between the interior and the outlet passage. It can also accommodate desiccating material in many orientations, and can be made of various materials.

The outer hosing of the accumulator may be of two or more pieces which can be welded, crimped, or otherwise hermetically joined together, and the inner liner has one or more pieces. The outer housing may have various fittings attached for switches, charge ports, or other items. The refrigerant enters the accumulator through an inlet which may be a tube or a hole in the top or side of the outer housing. An inlet tube may be integrally formed or snap-in, or be swaged, brazed, welded or otherwise attached. An inlet hole may be a simple hole or have features formed or machined into it, e.g. a flow director. To direct the flow, reduce turbulence, and/or aid in separating the gaseous refrigerant from the liquid, the inlet may have a diffuser, director, rain hat separator, or flow channellizer attached to, formed with, or held near the inner end. The inlet directs the refrigerant into the inner container formed by the liner. The liquid refrigerant and compressor oil settle to the bottom of the liner where they are contained and insulated from the wall of the outer housing, which may be hot according to the ambient temperature. Hence this arrangement reduces boiling and frothing which might otherwise lead to liquid carryover.

Evaporation of the refrigerant liquids can be controlled by adjusting the thermal connection between the inner liner and the outer housing.

Gaseous refrigerant from the inner container and drawn by the compressor must flow over the top of the inner liner through the annular gap between the liner and the outer housing. This gap may be baffled by features on the outer housing or on the liner, or by separately added pieces. The baffle can reduce the likelihood of liquid refrigerant splashing into the outlet and/or spilling out if the accumulator is tilted.

Furthermore, the peripheral gap can be formed by a plurality of fine holes, or by an attached filter element in order that the refrigerant gas can be filtered as it exits the inner container. The gap may also be sized for optimum flow and/or shaped for optimum coupling between the inner volume and the outlet passage, and may furthermore be designed to impart favourable momentum (e.g. spin) to the exiting refrigerant gas, all with no additional parts or significant additional cost. Since this outlet gap is at the very top of the accumulator the effective internal volume of the accumulator is maximized.

Refrigerant leaving the inner liner must flow down the annular passage between the liner and the outer housing to reach the bottom of the accumulator. The exiting refrigerant is thus in good thermal contact with the outer wall and can pick up heat from the external environment through that wall (which is typically of a good heat conducting material such as aluminium) thus evaporating any liquid refrigerant that may inadvertently have become entrained with the gas. It will be understood that this avoids the above discussed flooding phenomenon.

The outlet passage leading from the bottom of the accumulator towards the exterior may be in the form of a free-standing outlet tube within the liner or attached to an edge thereof, or may even be in thermal contact with the outer housing, again to improve evaporation of any liquid. The discharge end of the outlet tube may be directed out of the top or of the side of the outer housing.

In an alternative configuration wherein discharge from the accumulator is arranged to exit at the bottom thereof, the outlet tube is modified to become a tubular shield closed at its upper end, and within it is coaxially arranged an auxiliary outlet tube having an open upper end leading to an outlet at the bottom of the outer housing. In this arrangement the closed upper end of the tubular shield has a small hole to provide an anti-siphon action.

BRIEF DESCRIPTION OF THE DRAWINGS

The invention will further be described, by way of example only, with reference to the accompanying drawings wherein:

Referring to FIGS. 1 and 2, the components of the accumulator will be seen as comprising a two-part outer housing formed by an open-top bottom can 12 and a head cap 14, and a cup shaped cylindrical inner liner 16 that is sized to fit within the bottom can as shown in FIG. 5. As shown, the bottom can 12 is of thin walled cylindrical form and has a rounded base 18 and a circular top edge 20.

Figure 5:
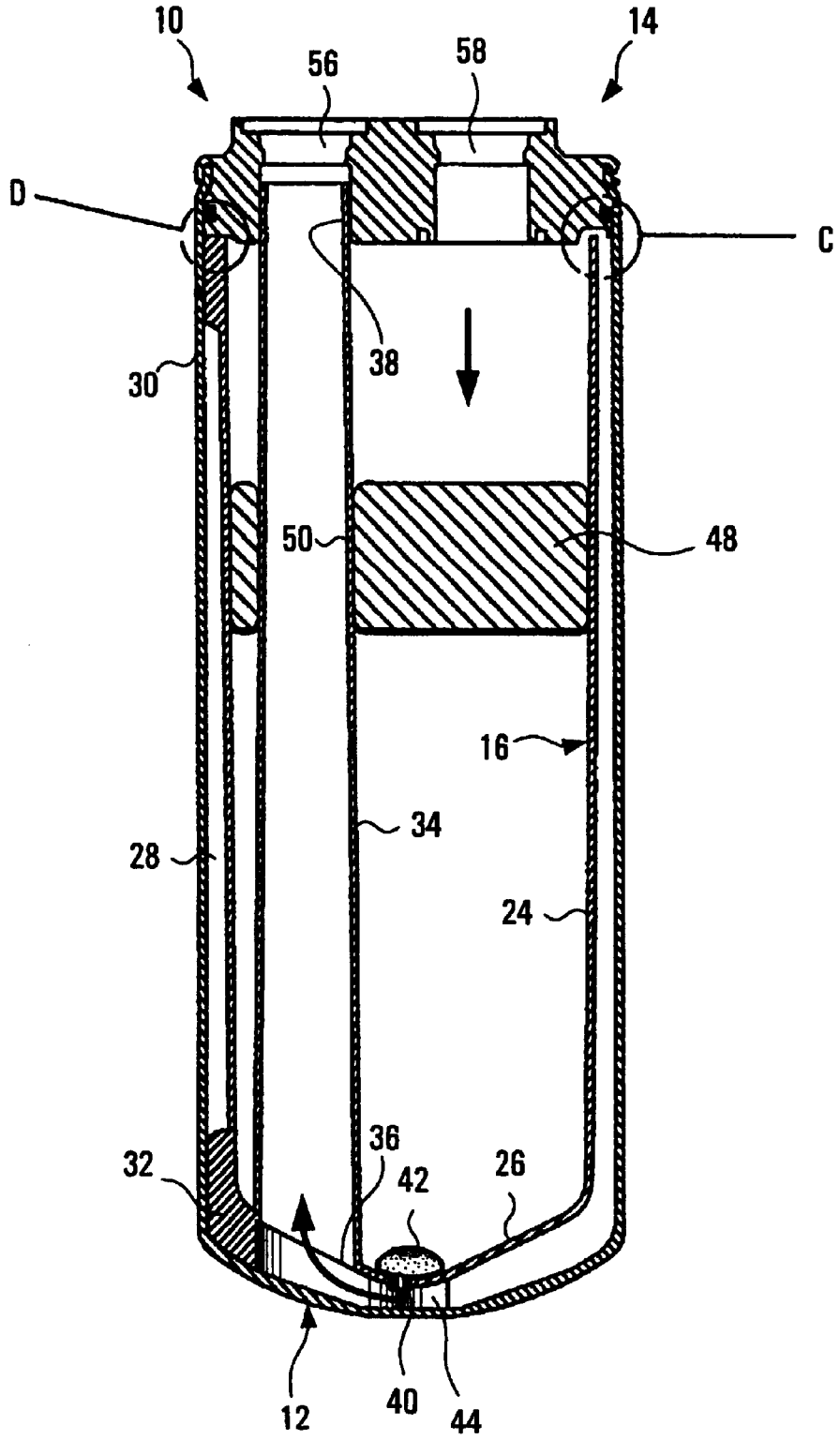
FIG. 5 is a longitudinal sectional view of the assembled accumulator.

The inner liner 16 is similar in shape to the bottom can 12 but is slightly smaller, having a thin cylindrical peripheral wall 24 and a rounded base 26, and fits within the bottom can 12 as shown in FIG. 5, the walls and bases of the bottom can 12 and inner liner 16 being mutually spaced to define an annular passage 28 which extends downwards from the top of the inner liner wall 16 to the base thereof.

Two sets of integral projections 30, 32 carried on the inner liner 16 are positioned to engage the inner sides of the bottom can wall and base (as shown in FIG. 5) and cooperate therewith to maintain the inner liner 16 at the desired location coaxially within the outer can 12.

A tubular conduit 34 has an opening 36 at the base 26 of the inner liner, the tubular conduit extending vertically within the inner liner to an upper end 38.

Figure 3:
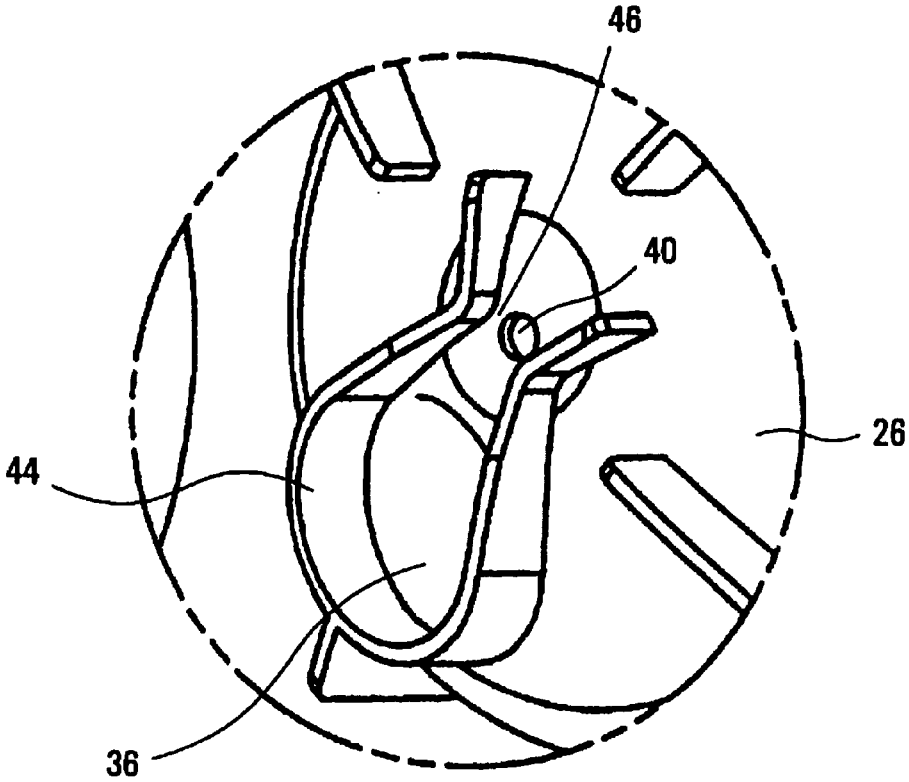
FIG. 3 is an enlarged view of the circled portion A from FIG. 2.
Figure 4:
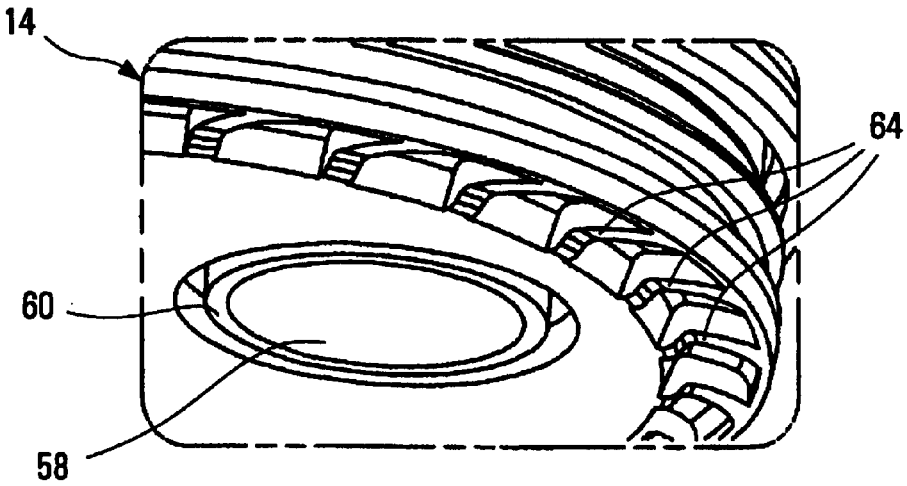
FIG. 4 is an enlarged view of the outlined portion B from FIG. 2.

In the base 26 of the liner at its lowermost point is a small oil bleed hole 40 at the upper side of which is an oil filter 42 within the bottom of the inner liner container. The base of the inner liner 16 also carries an integral somewhat U-shaped wall 44 (FIG. 3) which has a bight portion which surrounds part of the periphery of the opening 36 and two limbs which extend across the base first convergently and then divergently to form a narrowed throat 46 in the vicinity of the oil bleed hole 40. The wall 44 spans the spacing between the inner liner base 26 and the bottom can base 18.

A disc-shaped desiccant container 48 is located within the inner liner 16, the desiccant container being secured by any suitable means (not shown) to the tubular conduit 34 in the upper portion of the inner liner 16 as seen in FIG. 5, the container having a hole 50 through it in which the tubular conduit 34 is received. The desiccant container 48 has an outer diameter which fits closely against the interior of the wall 24 of the inner liner. The desiccant container 48 substantially fills the cross section of the inner liner 16, but is porous to a degree sufficient to permit flow of gas and drainage of liquid therethrough. However the desiccant container 48 is sufficiently dense as to prevent "sloshing" of liquid from the lower side to the upper side thereof e.g. during cornering, acceleration, or braking of an automobile.

The head cap 14 is of cylindrical disc-like form and is joined to the bottom can 12 as shown in FIG. 5 by an hermetic seal provided by swaging or crimping of a peripheral lip on the head can 14 into tight engagement with the upper edge 20 of the bottom can, and by the inclusion of an O-ring seal 54 received in a peripheral groove of the head cap 14 and engaging the inner surface of the wall of the bottom can.

The upper end 38 of the tubular conduit 34 is sealed in an outlet port 56 in the head cap 14 and sealed thereto by any suitable means.

An inlet port 58 also extends through the head cap 14 and opens into the interior of the inner liner 16. The inlet and outlet ports 58 and 56 are configured for attachment thereto in known manner of conduits (not shown) for supplying refrigerant from the evaporator of the air conditioning system and delivering refrigerant gas from the accumulator to the compressor of the system. On the underside of the head cap 4, the inlet port 58 is surrounded by a circumferential lip 60 which in use acts to overcome the Coanda effect and ensure that refrigerant liquid delivered to the accumulator through the port 58 is directed downwards into the liner reservoir, rather than clinging to and moving laterally on the underside of the head cap 14.

Figure 6:
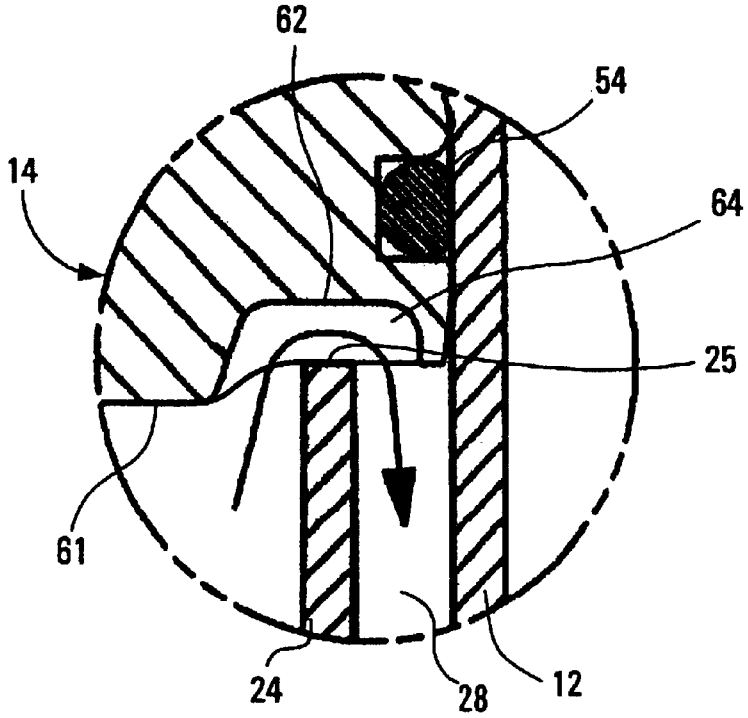
FIG. 6 is an enlarged view of the circled potion C in FIG. 5.
Figure 7:
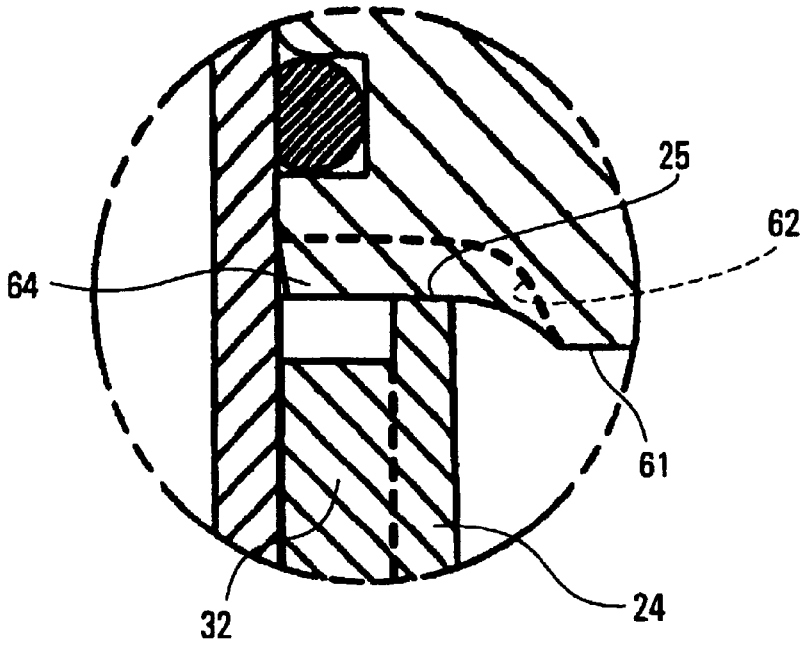
FIG. 7 is an enlarged view of the circled portion D in FIG. 5.

As seen in FIGS. 2, 4, 5 and 6, round the periphery of the lower side of the head cap 14 there is a series of passages 62 extending radially and partly circumferentially, these passages being separated by ribs 64. The components are dimensioned such that when the bottom can 12 is secured to the head cap 14, the upper edge 25 of the inner liner 16 is pressed against the series of ribs 64 (see FIG. 7) thus serving to fix the inner liner 16 against the cap 14. In this configuration as seen in FIG. 6 the passages 62 provide communication for gas flow from the container 16 to the annular passage 28. As seen in FIG. 6, the lower side 61 of the cap 14 is positioned at a level below the upper edge 25 of the inner liner 16, and this produces a baffle effect which reduces the likelihood of drops of liquid refrigerant entering directly into the passages 62.

In operation in an air conditioning system, as is well understood, a supply of liquid refrigerant will be contained in the accumulator, refrigerant gas being drawn from the accumulator, compressed, expanded and condensed and then delivered to an evaporator heat exchanger where it extracts heat from the air that is to be cooled, and is then returned to the accumulator. The flow of refrigerant returning to the accumulator 10 through the inlet 58 may contain both gas and liquid, and it is directed downwards and after passing through the desiccant container 48 the liquid is stored in a reservoir formed by the bottom of the inner liner 16.

To reach the outlet tube 34 from the inner container 16, refrigerant gas must pass over the upper edge 25 through the passages 62, these passages being curved as seen in FIG. 6 to provide smooth flow, and being angled in the peripheral direction to impart a spin to the exiting gas to improve heat transfer between the refrigerant gas flowing downwardly in the annular passage 28 and the wall 24 of the bottom can. Although the ribs 64 sit upon the upper edge 25 of the wall 24, this does not impede the gas flow since the projecting ribs 30 on the wall 24 terminate slightly below the edge 25, are thin and widely spaced, and there are numerous passages 62.

Figure 8:
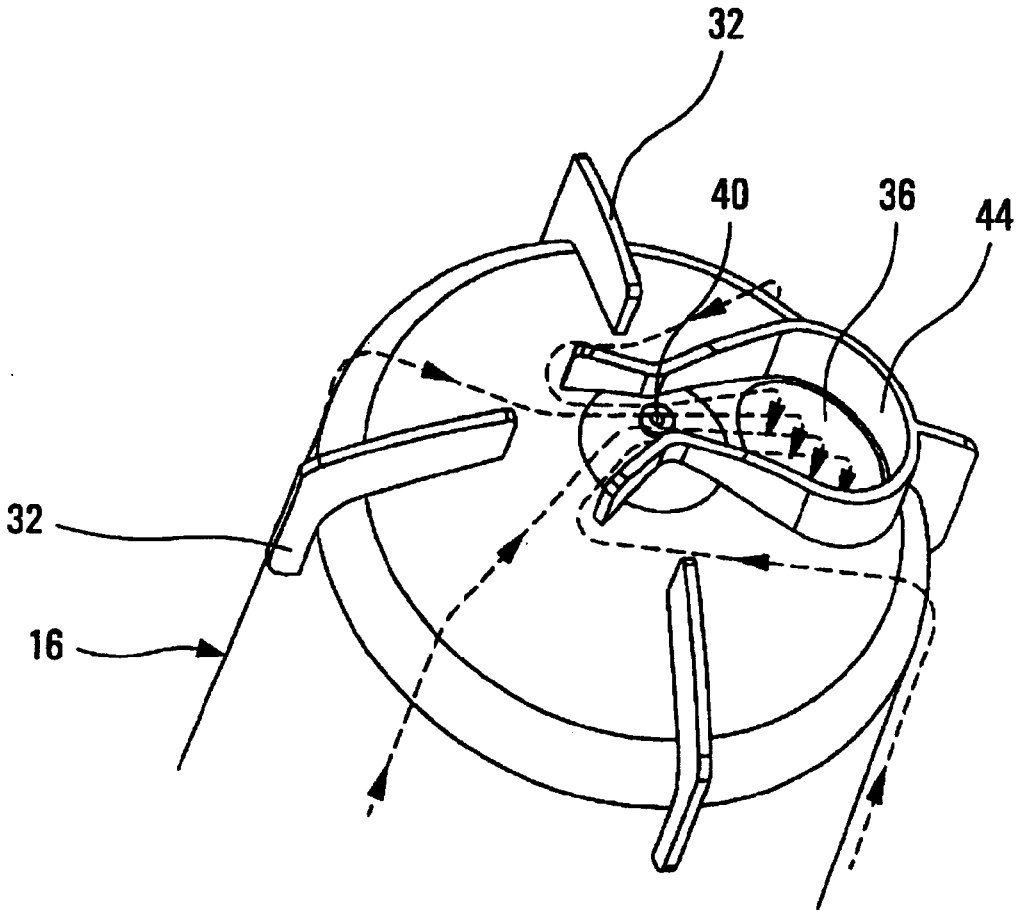
FIG. 8 is a perspective view of the bottom of the inner container of the accumulator.

The gas flow passes to the bottom of the annular passage and is then guided by the wall 44 to pass over the oil bleed hole 40 before reaching the opening 36 of the outlet conduit 34. In FIG. 8 the broken line arrows illustrate the gas flow path from the annular passage 28 to the inlet 36 of the conduit 34.

The oil bleed hole 40 is located at the lowest point of the liner to minimize oil inventory since oil entrained in the refrigerant will settle to the bottom of the liner. The bleed hole 40 is a small precision hole provided with a filter 42. The wall 44 is configured to provide a desired velocity of gas flow in the region of the oil bleed hole 40 to provide effective entrainment of oil from the hole 40 into the flowing gas stream. As shown, the wall 44 can define a venturi throat 46 to increase gas flow velocity at this region.

The components of the accumulator can be fabricated in any suitable materials. Typically the bottom can 12 will be fabricated in steel or a lightweight metal such as aluminium. These materials are of good thermal conductivity so that in a typical automotive installation the bottom can will gain heat from the engine compartment and will radiate that heat into the annular passage 28, which is desirable to maintain refrigerant in that passage in a gaseous state. However it is not desirable for such radiated heat to reach the reservoir of liquid refrigerant contained within the inner liner 16, and for this purpose the inner liner is made of the material of low heat conductivity such as plastic, possibly foamed into closed cells, or a composite such as a metal foil heat shield wrapping a foam or fibrous layer which is applied to the solid plastic core. A suitable plastics material is nylon. The inner liner 16 may be an integral plastic molding including the tubular conduit 34, the ribs 30 and 32 and the wall 44.

Various details of the above described and illustrated accumulator can be altered to suit particular circumstances. For example, rather than providing the passages 62 in the periphery of the head cap 14, passages could be provided as an annular gap between the upper edge 25 of the inner liner and the cap 14, or as a series of fine holes or a mesh and extending around the upper end of the inner liner.

Figure 1:
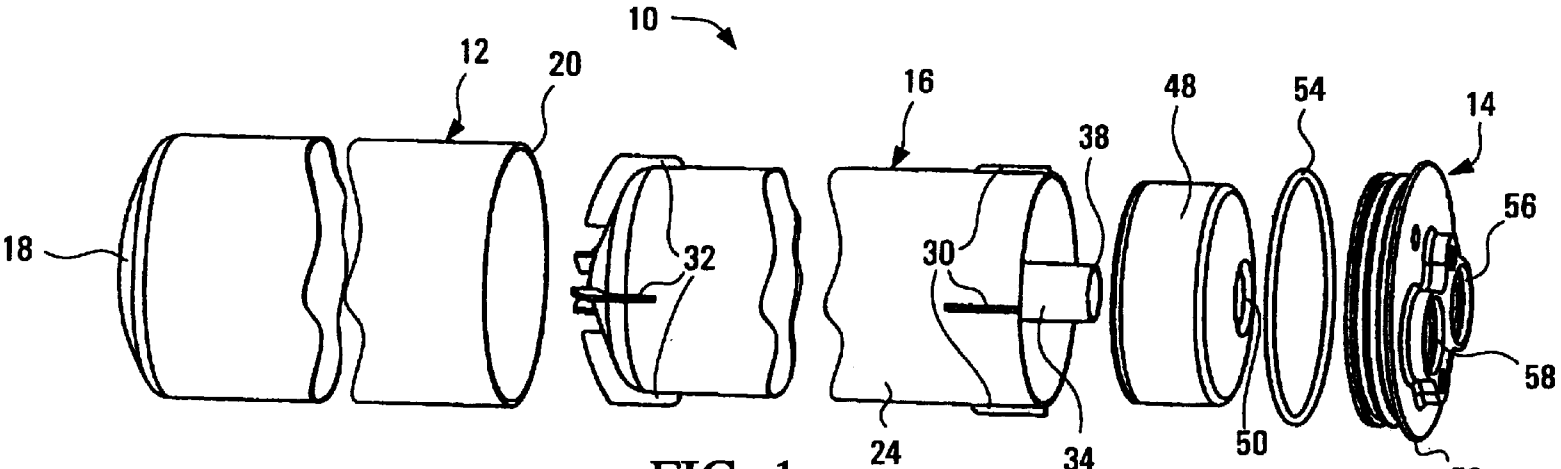
FIG. 1 is an exploded isometric view of one preferred embodiment of an accumulator in accordance with the present invention.
Figure 2:
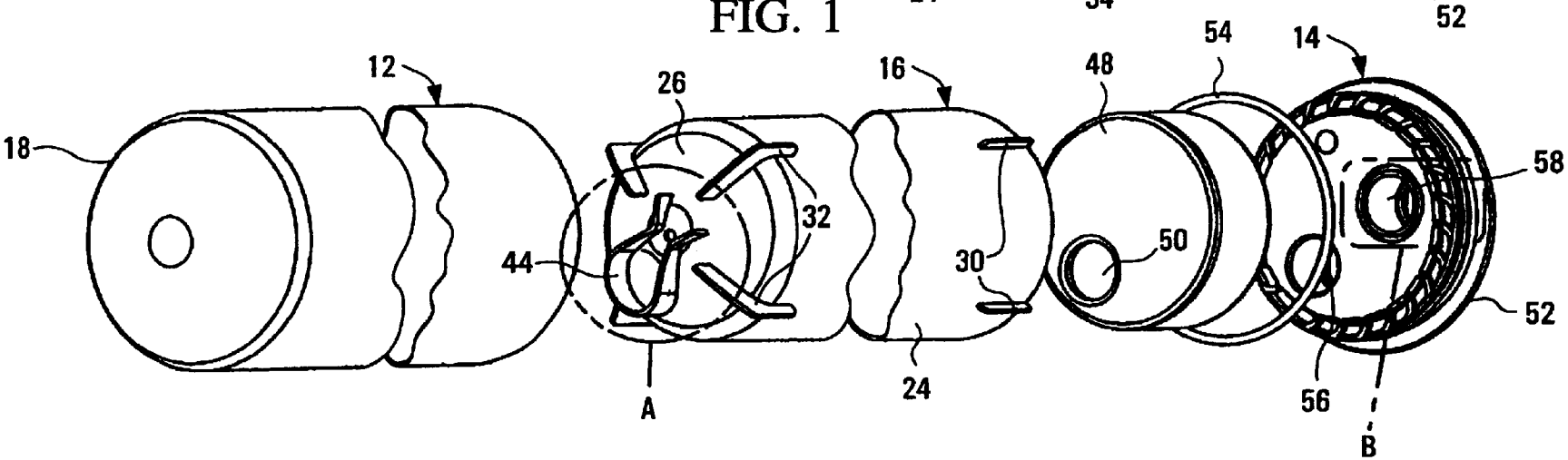
FIG. 2 is a view similar to FIG. 1 but showing the accumulator components from a different perspective.
Figure 9:
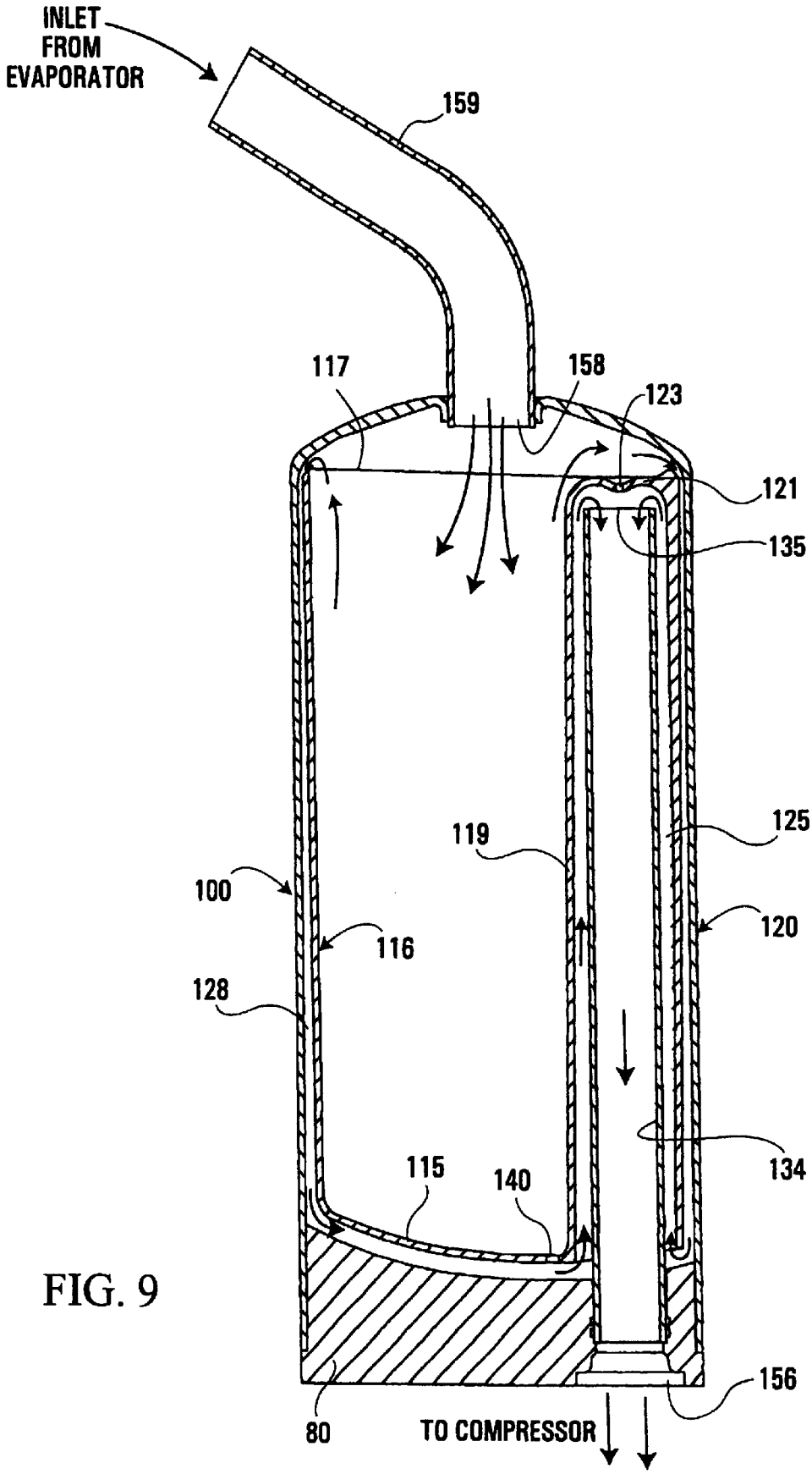
FIG. 9 is a longitudinal sectional view corresponding to FIG. 5 showing a second preferred embodiment of the accumulator in accordance with the present invention.

In the alternative embodiment shown in FIG. 9 the accumulator 100 has an inlet 158 at its upper end which is connected an inlet tube 159. However in this embodiment the outlet port 156 is located in a closure disc 80 which seals the lower end of the outer can 120. As before, the outer can is preferably formed as a steel or aluminium deep-drawn part with an open lower end sealed by the closure disc 10 and an upper end that is closed except for the inlet 158. This embodiment includes an inner plastic liner 116 that is somewhat similar to that disclosed in connection with FIGS. 1 to 8 in that it is of cylindrical form having an open upper end defined by a peripheral edge 117 and a closed lower end 115. The outer can 120 and inner liner 116 are spaced apart by any suitable means such as the projections 30 as shown in FIGS. 1 and 2 to define therebetween an annular passage 128.

The embodiment of FIG. 9 includes a modified outlet conduit 134 which is connected to the closure disc 80 in alignment with the outlet port 156 and which extends throughout almost the entire height of the accumulator, having an open upper end 135.

To accommodate the foregoing arrangement, the inner liner 116 is fabricated with an upwardly extending tubular shield 119 which concentrically surrounds the outlet conduit 134 and which has an upper end 121 spaced above the upper end 135 of the outlet conduit and essentially closed except for a small anti-siphon hole 123 therein.

The lower end of the shield 119 is integral with the lower end 115 of the inner liner 116, the latter being downwardly convex in shape and uniformly spaced from the similar shaped upper side of the bottom closure disc 80. A small oil bleed hole 140 is provided at the lowest point in the lower end 115. This oil bleed hole 140 may be provided in conjunction with a filter (not shown) and is provided to effect recirculation of the compressor oil which separates under gravity from the refrigerant liquid that is contained within the inner liner 116.

The accumulator 100 operates in a manner essentially similar to that of the one described in relation to FIGS. 1 to 8. A mixture of liquid and gaseous phase refrigerant is delivered from the evaporator (not shown) through the tube 159 to the inlet port 158. It will be noted that the inlet port 158 is spaced substantially below the adjacent top end surface of the outer can 120 to prevent migration of liquid refrigerant from the inlet port 158 along the wall of the outer can and into the annular passage 128. Refrigerant delivered through the tube 159 is directed downwardly into the reservoir defined by the inner liner 116 where the liquid and gaseous phases separate under gravity, gaseous refrigerant passing upwardly over the upper edge 117 of the inner liner and then downwardly through the annular passage 128 and beneath the lower end 115 into an annular passage 125 formed in the clearance between the tubular shield 119 and the outlet conduit 134. Gaseous refrigerant rises within this passage 125, passes over the upper edge 135 of the outlet conduit 134 and thence exits the accumulator downwardly through the outlet port 156. The configuration described above and illustrated in FIG. 9 reduces the likelihood of any drops of liquid refrigerant passing through the outlet 156 to the compressor. This is done by ensuring adequate separation of the liquid/gaseous phases within the inner liner 116 while providing a further opportunity for evaporation of any liquid droplets during movement downwardly in the passage 128 and upwardly in the passage 125.

Within the ambit of the invention significant changes can be made in the dimensions, shapes, sizes and materials to meet the requirements of the air conditioning system in which the accumulator is installed. Likewise the external structure such as the cap, outer can, and the position and arrangement of the inlet and outlet ports can be modified as desired, as can the type and arrangement of the desiccant container and the oil bleed regulator and filter. All such modifications and variations are intended to be encompassed within the scope of the appended claims.

What is claimed is:

1. An accumulator for use in air-conditioning system comprising:

a hermetically sealed outer housing comprising a top, an inlet opening, a peripheral side wall, and a base;

an inner liner positioned within said outer housing, said inner liner having a peripheral wall and a base which form a container to receive refrigerant delivered through said inlet opening, said inner liner being spaced from the peripheral wall and the base of said outer housing to define therewith an annular passage, said inner liner having an upper edge that is spaced from said outer housing;

passage means extending around the upper edge of said inner liner and communicating the interior of said inner liner with a first upper end of said annular passage;

an outlet passage opening from a second lower end of said annular passage at a location between the base of the inner liner and the base of the outer housing, said outlet passage leading to the exterior of said outer housing;

the arrangement being such that vaporized refrigerant can pass through said passage means from said inner liner to the upper end of said annular passage, descend downwards through said annular passage to the opening of said outlet passage, and exit said accumulator via said outlet passage.

2. An accumulator as claimed in claim 1 wherein said passage means is configured to create turbulence in any flow of refrigerant gas passing therethrough.

3. An accumulator as claimed in claim 1 wherein said inner liner has baffles in the interior thereof to prevent excessive movement of refrigerant liquid contained therein.

4. An accumulator as claimed in claim 1 including ribs interacting between said inner liner and said outer housing to maintain a predetermined spacing therebetween.

5. An accumulator as claimed in claim 1 wherein said inner liner is of a material of low thermal conductivity to prevent excessive evaporation of refrigerant contained therein as a result of heat radiating from said outer housing.

6. An accumulator as claimed in claim 1 including a bleed orifice in the base of said inner liner to permit oil, which gathers at the bottom of said inner liner, to pass through and become entrained in refrigerant gas flowing to said outlet passage opening.

7. An accumulator as claimed in claim 6 including guide ribs spanning between the bases of said inner liner and said outer container, said guide ribs being configured to direct flowing refrigerant gas to pass over said bleed orifice.

8. An accumulator as claimed in claim 7 wherein said guide ribs surround a major part of said inlet opening and define an entry port through which flowing refrigerant gas is ducted.

9. An accumulator as claimed in claim 8 wherein said entry port defines a venturi throat in the region of said bleed orifice.

10. An accumulator as claimed in claim 1 wherein said inner liner is of low thermal conductivity to shield liquid refrigerant therein from excessive heat transfer from said outer container.

11. An accumulator as claimed in claim 10 wherein said inner liner is of plastic material, either of closed-cell foam or solid, or of a composite material of metal and/or plastic layers.

12. An accumulator as claimed in claim 1 wherein the top of said outer housing is a cap formed as a separate component that is hermetically sealed to a top edge of the peripheral wall of the outer housing, said cap defining therein said inlet opening and outlet port for said outlet passage.

13. An accumulator as claimed in claim 1 wherein said inner liner includes integral projections on the exterior thereof, said projections being positioned to engage interior surfaces of the peripheral wall and base of the outer housing to maintain a predetermined spacing of the inner liner with respect thereto.

14. An accumulator as claimed in claim 12 wherein said passage means comprises a substantially continuous gap between the upper end of said inner liner and said cap.

15. An accumulator as claimed in claim 1 wherein said passage means is baffled to prevent entry thereto of liquid refrigerant delivered into said accumulator through said inlet opening.

16. An accumulator as claimed in claim 14 wherein the upper end of said inner liner is configured for engagement with said cap to provide proper alignment of said inner liner with respect to the outer housing.

17. An accumulator as claimed in claim 1 wherein said outlet passage leads to the exterior through an outlet opening in the lower end of said outer housing, said outlet opening being connected to an outlet tube extending longitudinally of the accumulator, the outlet tube having an open upper end and being located with clearance within a tubular shield that is carried on the inner liner and that has an open lower end in flow communication with said annular passage.

18. An accumulator as claimed in claim 17 wherein said outer container comprises a metal can having an open lower end sealed by a closure disc in which the outlet port is formed, the can having an integral upper end that is sealed except for an inlet conduit for delivering refrigerant to the accumulator.

* * * * *